US009097410B2

(12) United States Patent
Van Boven et al.

(10) Patent No.: US 9,097,410 B2
(45) Date of Patent: Aug. 4, 2015

(54) LIGHTING SYSTEM FOR PROVIDING A DAYLIGHT APPEARANCE AND A LUMINAIRE

(75) Inventors: Jacobus Dingenis Machiel Van Boven, Eindhoven (NL); Berent Willem Meerbeek, Eindhoven (NL); Gabriel-Eugen Onac, Veldhoven (NL); Evert Jan Van Loenen, Waalre (NL)

(73) Assignee: Koninklijke Philips N.V., Eindhoven (NL)

( * ) Notice: Subject to any disclaimer, the term of this patent is extended or adjusted under 35 U.S.C. 154(b) by 11 days.

(21) Appl. No.: 14/233,403

(22) PCT Filed: Jul. 5, 2012

(86) PCT No.: PCT/IB2012/053429

§ 371 (c)(1), (2), (4) Date: Jan. 17, 2014

(87) PCT Pub. No.: WO2013/011404

PCT Pub. Date: Jan. 24, 2013

(65) Prior Publication Data

US 2014/0160719 A1 Jun. 12, 2014

(30) Foreign Application Priority Data

Jul. 20, 2011 (EP) ..... 11174696

(51) Int. Cl.

| | |
|---|---|
| ***F21V 14/02*** | (2006.01) |
| ***F21S 10/02*** | (2006.01) |
| *F21W 121/00* | (2006.01) |
| *F21Y 101/02* | (2006.01) |

(52) U.S. Cl.

CPC ..... *F21V 14/02* (2013.01); *F21S 10/02* (2013.01); *F21S 10/026* (2013.01); *F21W 2121/008* (2013.01); *F21Y 2101/02* (2013.01)

(58) Field of Classification Search

CPC ..... F21S 10/02; F21S 10/026; F21V 14/02; F21W 2121/008; F21Y 2101/02

USPC ..... 362/1, 2, 242, 243

See application file for complete search history.

(56) References Cited

U.S. PATENT DOCUMENTS

| | | | | |
|---|---|---|---|---|
| 6,773,139 | B2 * | 8/2004 | Sommers | 362/237 |
| 7,722,224 | B1 | 5/2010 | Coleman et al. | |

(Continued)

FOREIGN PATENT DOCUMENTS

| | | | |
|---|---|---|---|
| EP | 1909025 | A2 | 4/2008 |
| EP | 2330344 | A2 | 6/2011 |
| WO | 2008152561 | A1 | 12/2008 |

*Primary Examiner* — Stephen F Husar

(74) *Attorney, Agent, or Firm* — Meenakshy Chakravorty

(57) ABSTRACT

A lighting system for providing a daylight appearance and a luminaire are provided. The lighting system comprises a plurality of light emitters and a plurality of optical elements. Said plurality of light emitters emit a wide light beam. Each optical element of at least a subset of the plurality of optical elements is related to a light emitter of the plurality of light emitters, thereby forming a pair. For each pair it applies that if a light emitter of a pair is arranged in a first relative position with respect to the optical element of said pair, the light emitter and the optical element are configured to emit the wide light beam, and if the light emitter of the pair is arranged in a second relative position with respect to the optical element of said pair, the optical element is configured to collimate a portion of the wide light beam to obtain a collimated light beam, and the optical element is configured to absorb another portion of light of the wide light beam in a predefined spectral range to obtain a blue light emission at light emission angles at least outside the collimated light beam.

9 Claims, 5 Drawing Sheets

(56) References Cited

U.S. PATENT DOCUMENTS

2003/0117797 A1 6/2003 Sommers et al.
2004/0174706 A1* 9/2004 Kan ..... 362/241
2006/0158887 A1 7/2006 Holder et al.
2010/0065860 A1 3/2010 Vissenberg et al.
2010/0165618 A1 7/2010 Vissenberg et al.

* cited by examiner

LIGHTING SYSTEM FOR PROVIDING A DAYLIGHT APPEARANCE AND A LUMINAIRE

FIELD OF THE INVENTION

The invention relates to lighting systems for providing artificial daylight.

BACKGROUND OF THE INVENTION

The importance of daylight in people's daily life has been recognized for some time. Daylight affects our biological rhythm and stimulates, for example, the production of vitamins. Light sources have been developed which provide artificial daylight that should give the look and feel of daylight. The focus of the known artificial daylight light sources is mainly on high intensity light sources, tunable color temperature and slow dynamic (for example, to simulate the day/night rhythm). However, these parameters of the artificial daylight light sources provide a limited daylight appearance.

SUMMARY OF THE INVENTION

It is an object of the invention to provide a lighting system which provides a better daylight appearance.

A first aspect of the invention provides a lighting system as claimed in claim 1. A second aspect of the invention provides a luminaire as claimed in claim 9. Advantageous embodiments are defined in the dependent claims.

A lighting system for providing a daylight appearance in accordance with the first aspect of the invention comprises a plurality of light emitters and a plurality of optical elements. The light emitters of the plurality of light emitters emit a wide light beam. Each optical element of at least a subset of the plurality of optical elements is related to a light emitter of the plurality of light emitters, thereby forming a pair. For each pair it applies that if a light emitter of a pair is arranged in a first relative position with respect to the optical element of said pair, the light emitter and the optical element are configured to emit the wide light beam, and if the light emitter of the pair is arranged in a second relative position with respect to the optical element of said pair, the optical element is configured to collimate a portion of the wide light beam to obtain a collimated light beam, and the optical element is configured to absorb another portion of light of the wide light beam in a predefined spectral range to obtain a blue light emission at light emission angles at least outside the collimated light beam.

The lighting system according to the first aspect of the invention is capable of emitting light that has two important characteristics of daylight. On a sunny day, daylight mainly exists of direct white light and more diffuse blue light. If specific light emitters are arranged in the second relative position, the collimated light beam provides light that is comparable to direct sunlight, and the blue light emission outside the collimated light beam provides the look and feel of the blue sky. If a cloud is in front of the sun, daylight is not emitted in a collimated light beam, but is received from a plurality of light emission angles, which is the case with the wide light beam. Therefore, the light emitters which are arranged in the first relative position emit light that is comparable to daylight on a cloudy day. Thus, the lighting system provides possibilities to emit light that is well comparable to daylight conditions on a sunny day, and is capable to emit light that is well comparable to daylight conditions on a cloudy day. Hence, the lighting system is better capable of providing a daylight appearance than the artificial daylight light sources known in the art.

The first relative position and the second relative position of the light emitters of the pairs are physical locations of the light emitters of the pairs with respect to the optical element of the respective pairs. It is to be noted that the light emitter may be positioned in such a relative position by moving the light emitter, the optical element, or both. Further, the first relative position is a different position from the second relative position.

The light emitters emit a wide beam. Each light beam has a maximum light emission angle with respect to a central axis of the light beam. Optionally, the maximum light emission angle of the wide light beam is larger than 45 degrees. Optionally, the maximum light emission angle of the wide light beam is larger than 60 degrees. The collimated light beam has a different maximum light emission angle which is at least significantly smaller than the maximum light emission angle of the wide light beams emitted by the light emitters. Optionally, said different maximum light emission angle of the collimated light beam is less than half the maximum light emission angle of the light beams emitted by the light emitters. Optionally, said different maximum light emission angle of the collimated light beam is less than one third of the maximum light emission angle of the light beams emitted by the light emitters.

The light that is emitted by the light emitters may be white light. This means that the wavelength distribution of the white light is such that a color point of the white light is a color point on or close to a black body line of the color space. Light with a color point on the black body line is perceived by the human naked eye as being in the range of cool-white to warm-white light. Direct sunlight is also white light and has a color point close to or on the blackbody line of the color space. Direct sunlight also varies, depending on the time of day and atmospheric conditions, between cool-white and warm-white.

The pairs of one optical element and one light emitter provide the same effect, which means that, depending on the relative position of the light emitter, the light emission is a wide light beam, or the light emission is a collimated light beam combined with a blue light emission at least outside the collimated light beam. Thus, the optical elements are similar to each other, and may be identical to each other.

It is further to be noted that the pairs comprise at least one light emitter and at least one optical element. Optionally, two light emitters are associated with one optical element, or two optical elements are associated with a single light emitter.

Optionally, the light emitter of a light emitter-optical element pair may have other relative positions in between the first relative position and the second relative position to obtain a light emission that is a combination of the wide light beam, the collimated light beam and the blue light emission at least at light emission angles outside the collimated light beam. With more than two relative positions different daylight appearances may be created which match situations in between a cloudy and a sunny day.

Optionally, the lighting system further comprises a controller to control the lighting system to operate in a sunny daylight mode or a cloudy daylight mode. The lighting system is configured to activate the light emitters which are arranged in the second relative position in the sunny daylight mode. The lighting system is configured to activate light emitters which are in the first relative position in the cloudy daylight mode.

Thus, the controller may change the operational mode of the lighting system and therefore the provided daylight appearance also comprises the perception of a cloud that moves along the sun and/or the perception of cloudy days and sunny days. This option, therefore, provides a much better and more realistic daylight perception. The control of the operational mode of the lighting system may take place automatically, for example, based on pre-programmed scenes, or based on sensor data, weather information, or any other type of input data.

Optionally, the controller is configured to control the lighting system to operate in a mixed mode which is in between the sunny daylight mode and the cloudy daylight mode.

Optionally, the light emitters may be moved between the first relative position and the second relative position, and vice versa, in response to receiving a control signal. The controller is configured to generate the control signal.

Thus, the control signal indicates that a majority of the light emitters have to be in the first relative position when the lighting system has to operate in a cloudy daylight mode. Further, the control signal indicates that a majority of the light emitters have to be in the second relative position when the lighting system has to operate in a sunny day mode. Optionally, the control signal indicates that all light emitters have to be in the first relative position when the lighting system has to operate in a cloudy daylight mode, and the control signal indicates that all light emitters have to be in the second relative position when the lighting system has to operate in the sunny daylight mode.

The lighting system may comprise micro actuators which are arranged to move the light emitters between the respective first and the respective second relative position, and vice versa. Thus, the difference between the sunny daylight mode and the cloudy daylight mode is made by moving the light emitters relative to their related optical elements. Hence, the distinction between the operation modes is made in the spatial domain.

Optionally, a first subset of the light emitters is arranged in the first relative position with respect to its related optical element and a second subset of the light emitters is arranged in the second relative position with respect to its related optical element. The controller is configured to control the light emitters of the first subset to emit light when the lighting system has to operate in a cloudy daylight mode and to control the light emitters of the second subset to emit light when the lighting system has to operate in a sunny daylight mode. Thus, the light emitters have a relative position which is known by the controller and the controller controls the light emitters according to this knowledge such that only light emitters of the second subset are controlled in the sunny daylight mode and only light emitters of the first subset are controlled in the cloudy daylight mode. Thus, the difference between the sunny daylight mode and the cloudy daylight mode is made by subdividing the group of light emitters in subsets. Hence, the distinction between the operational modes is made in the electrical domain. It is to be noted that the light emitters may be provided in their specific relative position during the manufacture of the lighting system, or that, optionally, the user has the possibility to select for each light emitter a specific relative position with respect to its related optical element.

Optionally, only the light emitters of the first subset are controlled to emit light in the cloudy daylight mode, and only the light emitters of the second subset are controlled to emit light in the sunny daylight mode.

Optionally, the light emitters may be moved between the first relative position and the second relative position, and vice versa. The lighting system is arranged to enable a user of the lighting system to move at least a subset of the light emitters from the first relative position to the second relative position and vice versa, or to move at least a subset of the optical elements to arrange the subset of light emitters in the first relative position or in the second relative position. This option of the invention provides the users with the possibility to select the mode in which they want the lighting system to work. If the light emitters are moved to their first relative position, the wide light beams are emitted, which relates to the light of a cloudy day. If the light emitters are moved to their second relative position, collimated light beams and blue light emissions outside the collimated light beams are emitted. The collimated light beams and the blue light emissions are similar to the daylight of a sunny day. The lighting system may comprise moving means for enabling the user to move the light emitters between their respective relative positions, such as, for example, a mechanical construction which moves all light emitters or which moves the optical elements.

Optionally, the optical elements comprise a light transmitting cavity. Each light transmitting cavity comprises a light exit window and walls which face the light transmitting cavity. The walls are light reflective in a blue spectral range. The light emitters are arranged within the light transmitting cavities of their related optical elements. The first relative position of a specific light emitter is a position near the light exit window of the light transmitting cavity. Near the light exit window of the light transmitting cavity means that the wide light beam is emitted into the ambient without hitting the walls of the light transmitting cavity.

The second relative position of a specific light emitter is a different position inside the light transmitting cavity. Said different position is at a distance from the light exit window and in said different position, the specific light emitter is arranged to partially emit light towards the walls. Consequently, the second relative position is not near the light exit window. If the light emitters are in the second relative position, a part of the light impinges on the walls. Another part which does not impinge on the walls is collimated towards the collimated light beam. Said part of the light which impinged on the walls has light emission angles which are outside the collimated light beams. The walls reflect the blue light and, as a result, the blue light emission at light emission angles outside the collimated light beam is obtained. The walls may also be diffusely reflective, such that the blue light emission is obtained at all possible light emission angles.

If the light emitters are in the first relative position near the light exit window, the light is not collimated and not reflected in the blue spectral range, and therefore the wide light beams, as they are emitted by the light emitters, are emitted via the light exit window.

Optionally, the light transmitting cavity is a cylindrical light transmitting channel, a conically shaped cavity tapering out towards the light exit window, or a cavity having a curved profile. Light transmitting channels are relatively easy to manufacture and are a relatively cheap solution for the optical elements. Examples of a curved profile include a parabolic concentrator or a compound parabolic concentrator. The different options for the light transmitting cavity have to be shaped such that, if the light emitter is in the first relative position, the light beam of the light emitter is not collimated, and if the light emitters are in the second relative position, the light is partly collimated and partly converted to a blue light emission at least outside the collimated light beam.

Optionally, each optical element comprises a light guide part and a recess. Each light guide part comprises a light input window facing the recess, an exit window of the light guide light arranged on a first side of the light guide part, and light outcoupling structures arranged on a second side of the light guide part opposite the first side. Each recess comprises a recess light output window on the first side of the light guide part and extending from the second side to the first side of the light guide part. The light emitters are arranged within the recess of the light guide part of the related optical element. The first relative position of a specific light emitter is a position near the light exit window of the recess. Near the light exit window of the recess means that the wide light beam is emitted into the ambient without hitting the walls of the recess. The second relative position of a specific light emitter is a different position inside the recess. Said different position is at a distance from the light exit window of the recess. The light guide part is arranged to capture via the light input window a part of the light emitted by the specific light emitter if said different specific light emitter is arranged in the second relative position. The light outcoupling structures are light reflective in a specific spectral range to obtain a blue light emission through the light guide light exit windows of the light guide parts and/or the light guide parts are at least partly light transmissive in the specific spectral range to obtain a blue light emission through the light guide light exit windows of the light guide parts.

The second relative position, thus, is not near the light exit window. Consequently, if the light emitters are in the second relative position with respect to the optical element, they are at a specific location within the recess such that a part of the light emitted by the light emitters is directly transmitted towards the light exit window of the recess and, thus, this light becomes a collimated light beam, and a part of the light emitted by the light emitters is captured by the light guide parts. The light guide part itself is blue transmissive, or the light outcoupling structures are blue reflective, and as a result the captured light is converted at a specific location to blue light. The outcoupling structures couple out the light via the light exit window of the light guide and, in general, this light is outcoupled in a plurality of light emission directions and therefore also at light emission angles outside the collimated light beam. Consequently, an advantageous light emission comparable to a sunny day is obtained. In the first relative position, the light emitters mainly emit the light via the light exit window of the recess into the ambient of the lighting system and, thus, the wide light beams are emitted into the ambient. This light emission is comparable to the daylight of a cloudy day.

It is to be noted that a recess may also be a light transmitting channel which extends from one side of the light guide part to another side of the light guide part and only a thin foil, or the light emitter, or another means of the lighting system, seals a specific side of the light transmitting channel, which is not the light exit window of the recess.

It is to be noted that a part of the light guide parts may be light transmissive in the specific spectral range such that the blue light emission is obtained. For example, the light input window of the light guide part may be transmissive in the specific spectral range. Optionally, the whole light guide part is light transmissive in the specific spectral range.

According to a second aspect of the invention, a luminaire is provided which comprises the lighting system according to the first aspect of the invention. The luminaire provides the same features and advantages as the different optional embodiments of the lighting system.

These and other aspects of the invention are apparent from and will be elucidated with reference to the embodiments described hereinafter.

It will be appreciated by those skilled in the art that two or more of the above-mentioned options, implementations, and/or aspects of the invention may be combined in any way deemed useful.

Modifications and variations of the system, which correspond to the described modifications and variations of the system, can be carried out by a person skilled in the art on the basis of the present description.

Figure 1:
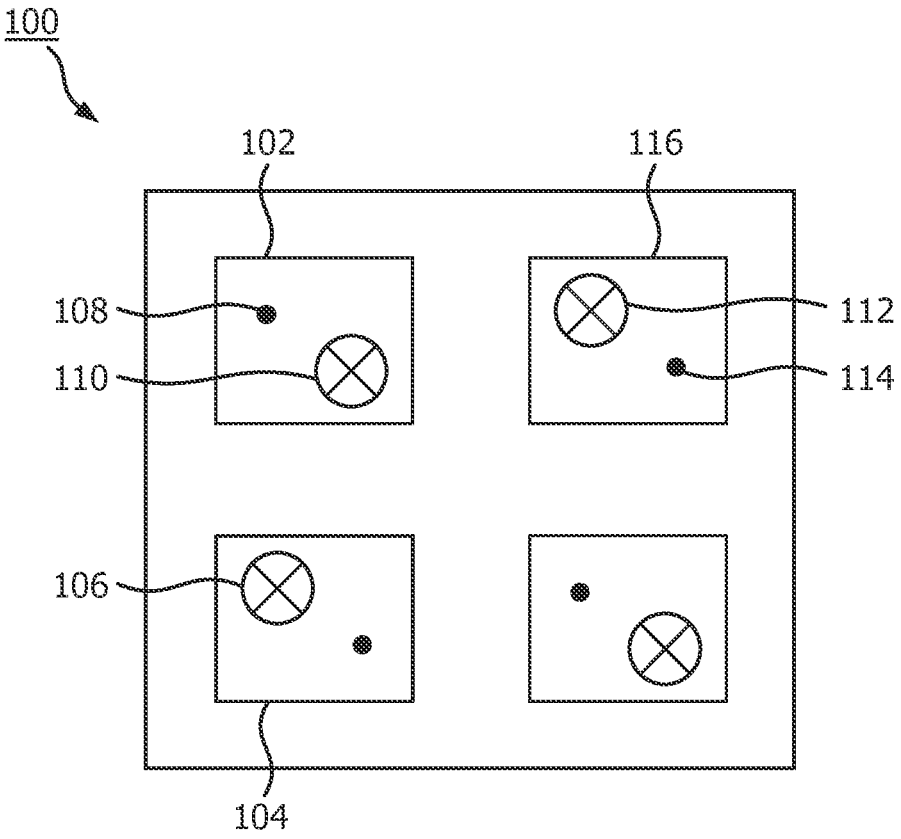
FIG. 1 schematically shows the lighting system according to the first aspect of the invention, FIG. 2 schematically shows a cross-section of an embodiment of the lighting system, FIG. 3 schematically shows a cross-section of an embodiment of a lighting system which comprises a controller, FIG. 4 schematically shows a cross-section of an embodiment of a lighting system comprising means to manually move light emitters within the light transmitting cavity, FIG. 5*a* schematically shows a cross-section of an embodiment of a lighting system which comprises light guide parts being blue transmissive, FIG. 5*b* schematically shows a cross-section of an embodiment of a lighting system which comprises light guide parts with blue reflective outcoupling structures, FIG. 6*a* schematically shows a luminaire comprising the lighting system in a sunny daylight operational mode, FIG. 6*b* schematically shows a luminaire comprising the lighting system in a cloudy daylight operational mode.

It should be noted that items denoted by the same reference numerals in different Figures have the same structural features and the same functions, or are the same signals. Where the function and/or structure of such an item have been explained, there is no necessity for repeated explanation thereof in the detailed description.

The figures are purely diagrammatic and not drawn to scale. Particularly for clarity, some dimensions are exaggerated strongly.

DETAILED DESCRIPTION OF THE EMBODIMENTS

A first embodiment is shown in FIG. 1. FIG. 1 schematically shows a lighting system 100 according to the first aspect of the invention. The lighting system 100 comprises a plurality of optical elements 102, 104, 116 and a plurality of light emitters 106, 110, 112. The light emitters are configured to emit a relatively wide light beam, which means, in practical cases, that the maximum light emission angle of the light beam is about 60 degrees with respect to a central axis of the wide light beam. Each light emitter 106, 110, 112 is related to one of the optical elements 102, 104, 116. In the lighting system 100, light emitter 110 is related to optical element 102, light emitter 112 is related to optical element 116 and light emitter 106 is related to optical element 104. The light emitters 106, 110, 112 may be arranged in two or more relative positions with respect to the related optical elements 102, 104, 116. In the schematic drawing of FIG. 1, light emitter 106 is positioned in a first relative position with respect to its related optical element 104, light emitter 110 is positioned in a second relative position with respect to its related optical element 102 while the first relative position 108 is empty, light emitter 112 is positioned in the first relative position with respect to its optical element 116 while the second relative position 114 is free. As discussed above, the light emitters may also be arranged in another relative position, for example, in between the respective first and the respective second relative position such that a light emission is obtained which partly relates to direct sunlight and partly relates to daylight of a cloudy day.

If a specific light emitter is in the first relative position 108, the wide light beam of the light emitter 110, 112, 106 is emitted into the ambient of the lighting system 100. If a specific light emitter is in the second relative position 114, a part of the light beam emitted by the light emitter 110, 112, 106 is collimated into a collimated light beam, and a part of the light of the light beam is converted into a blue light emission at least at light emission angles outside the collimated light beam. Thus, when the light emitters 106, 110, 112 are in the first relative position, a relatively wide light beam is emitted. Such a light beam is comparable to daylight of a cloudy day. And, when the light emitter 106, 110, 112 is in the second relative position, two light emissions take place: a relatively narrow collimated light beam and a relatively wide blue light emission. Such light is comparable to daylight of a sunny day.

It is to be noted that FIG. 1 is a purely schematic drawing. Although it seems that FIG. 1 suggests that the first relative position and the second relative position are different positions in the plane of FIG. 1, the first relative position and the second relative position may be different in another dimension instead of being different in the plane of FIG. 1.

Figure 2:
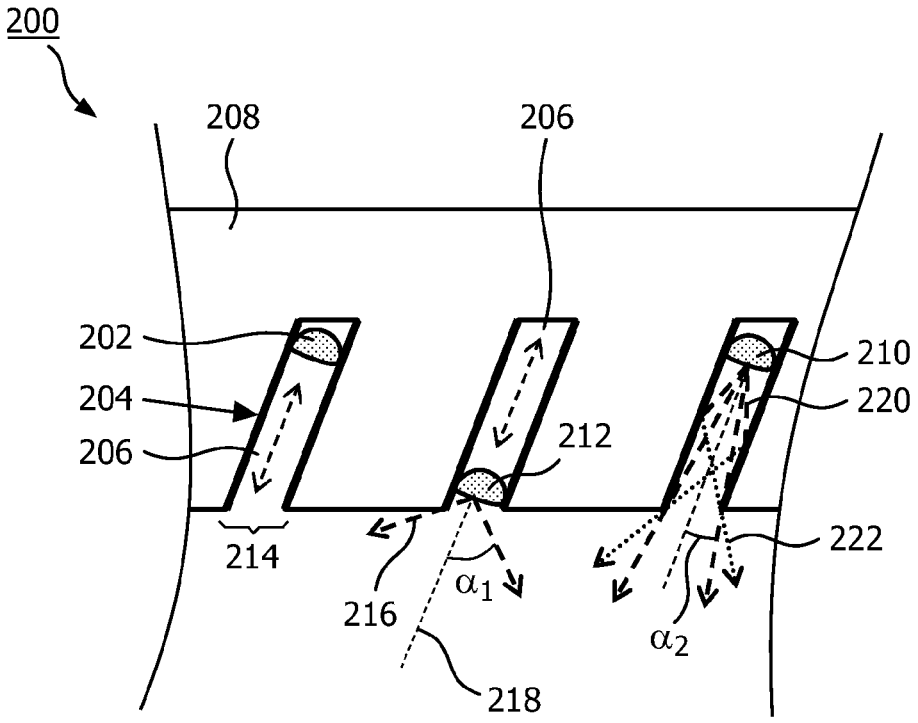

FIG. 2 schematically presents a cross-section of an embodiment of a lighting system 200. The lighting system comprises a housing 208 which comprises light transmitting channels 206 which each have blue reflective walls 204 and which each have a light exit window 214. Inside the light transmitting channels 206 are provided light emitter 202, 210, 212, which are, for example, light emitting diodes which emit white light in a relatively wide light beam. The light emitters 202, 210, 212 emit light at a maximum light emission angle $\alpha_1$ with respect to a central axis 218 of the light beam. The light emitters 202, 210, 212 are moveable within the light transmitting channels 206. The maximum light transmission angle $\alpha_1$ is relatively large, for example, larger than 45 degrees.

Light emitter 212 is positioned in the first relative position with respect to its related light transmitting channel 206. The first relative position is close to the light exit window 214. In this first position, the light rays of the light beam emitted by the light emitter 212 do not impinge on the walls 204 of the light transmitting channels or any other surface of the housing 208. Consequently, the wide light beam (with the maximum light emission angle $\alpha_1$) is emitted into the ambient of the lighting system 200. Light ray 216 is the light ray which is emitted at the maximum light emission angle $\alpha_1$. It is to be noted that the direction of the central axis 218 may be the direction in which the collimated light beam is emitted.

The light emitters 202, 210 are positioned in a second relative position with respect to their related light transmitting channels 206, which is at the end of the light transmitting channels opposite the light exit window. As schematically presented for light emitter 210, a part of the light that is emitted by the light emitter 210 is transmitted directly to the light exit window 214 and is emitted as a collimated light beam into the ambient. The collimated light beam has another maximum light emission angle $\alpha_2$ which is significantly smaller than the maximum light emission angle $\alpha_1$ of the wide light beams of the light emitters 202, 210, 212. Another part of the light that is emitted by light emitter 210 impinges on the walls 204 and the non-blue components of the impinging light are absorbed by the walls and the blue components are reflected. This is, for example, shown by means of light ray 220 which impinges on the blue wall and is emitted as a blue light ray 222 outside the collimated light beam.

As pointed out, the light emitters may be light emitting diodes which emit white light. In other embodiments, the light emitters may be miniaturized traditional incandescent light sources or miniaturized halogen lamps. Further, the light emitter may be a light emitting diode with a luminescent material which emits a specific color combination to obtain a white light emission.

Figure 3:
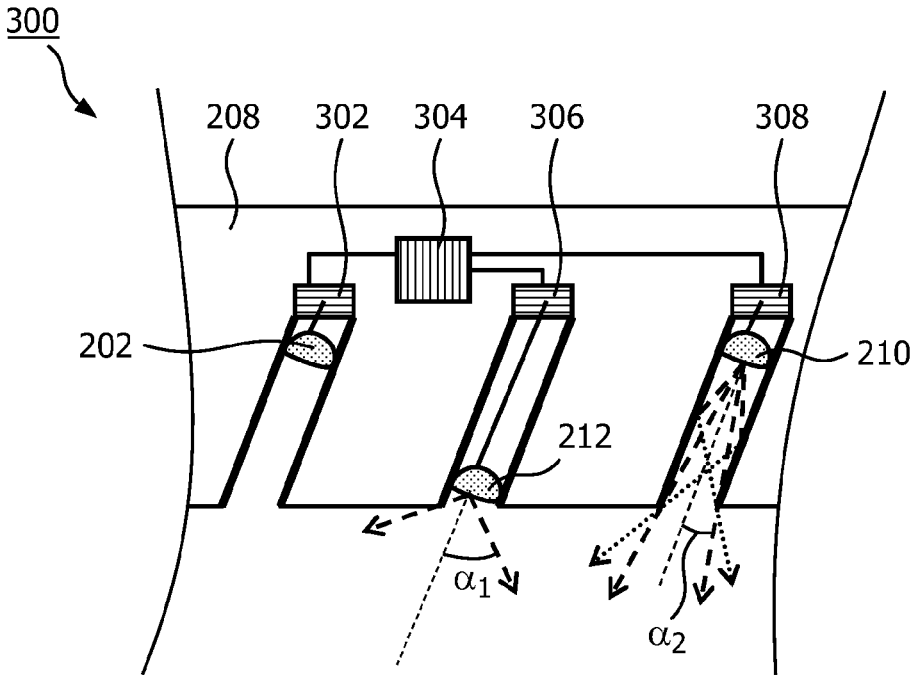

In FIG. 3, a cross-section of another embodiment of the lighting system 300 is schematically presented. The lighting system 300 is similar to the lighting system 200 of FIG. 2, with the exception that the housing 208 comprises additional means, namely, a controller 304 and three actuators 302, 306, 308. Each actuator 302, 306, 308 is mechanically coupled to one of the light emitters 202, 210, 212 and each actuator 302, 306, 308 is capable of moving its light emitter 202, 210, 212 from the first relative position to the second relative position and vice versa. The actuators 302, 306, 308 receive a control signal from the controller 304. The control signals indicate into which position the light emitters 202, 210, 212 must be moved by the actuators 302, 306, 308. The controller 304 controls the light emitters 202, 210, 212 into the first relative position if the lighting system 300 has to operate in a cloudy daylight mode, and into the second relative position if the lighting system 300 has to operate in a sunny daylight mode. The controller 304 receives, for example, electronic input indicating in which mode the lighting system 300 has to operate, or the controller has a daylight simulation model in which local daylight situations are simulated, or the controller electronically receives weather information and follows the outdoor daylight conditions.

It is to be noted that the controller 304 may also control the on and off state of the light emitters 202, 210, 212. The controller 304 may, for example, switch off a number of light emitters 202, 210, 212 if the emitted intensity has to be decreased. The controller 304 only switches on the light emitter(s) 212 which are moved into the first relative position when the lighting system 300 has to operate in the cloudy daylight mode, and the controller 304 only switches on the light emitter(s) 202, 210 which are moved into the second relative position when the lighting system 300 has to operate in the sunny daylight mode.

Figure 4:
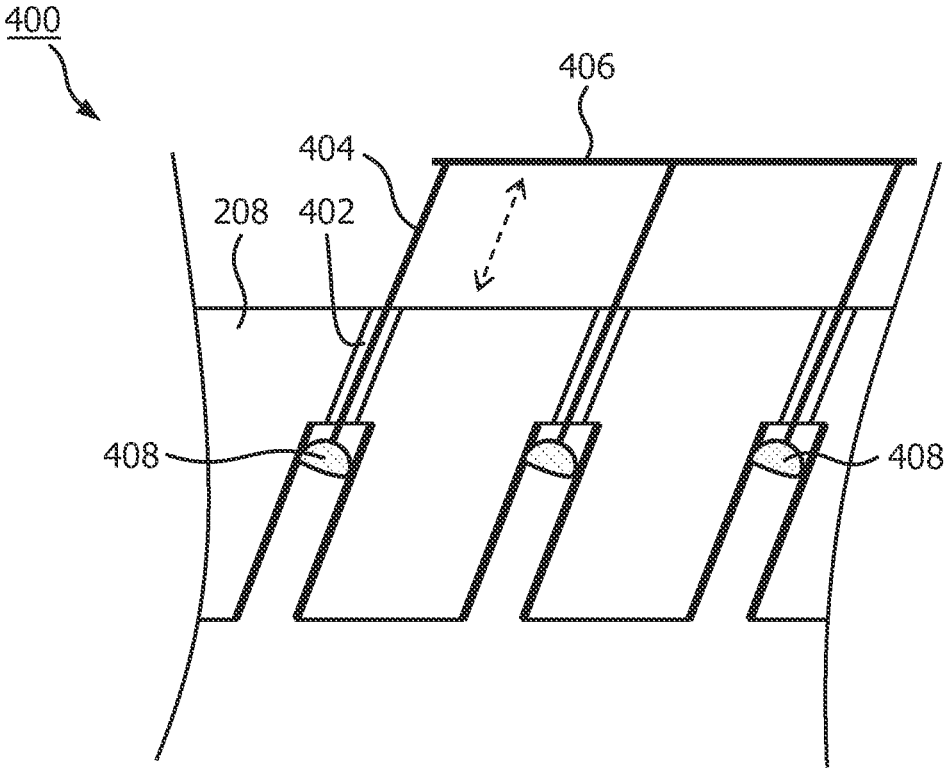

In FIG. 4, another cross-section of a further embodiment of the lighting system 400 is schematically presented. The lighting system 400 is similar to the lighting system 300, however, the movement of the light emitter 408 is performed differently. The housing comprises channels 402. Bars 404 are provided within the channels 402 and the bars 404 are connected to the light emitters 408 which are provided within the light transmitting channels. All the bars 404 are connected to a shared bar 406 which may be used by a user to move the light emitters 408 from the first relative position to the second relative position and vice versa. This embodiment enables the user to select in which operational mode the lighting system 400 has to operate. In another embodiment, the shared bar 406 is absent for enabling the user to control the relative position of each light emitter 408 individually.

Figure 5A:
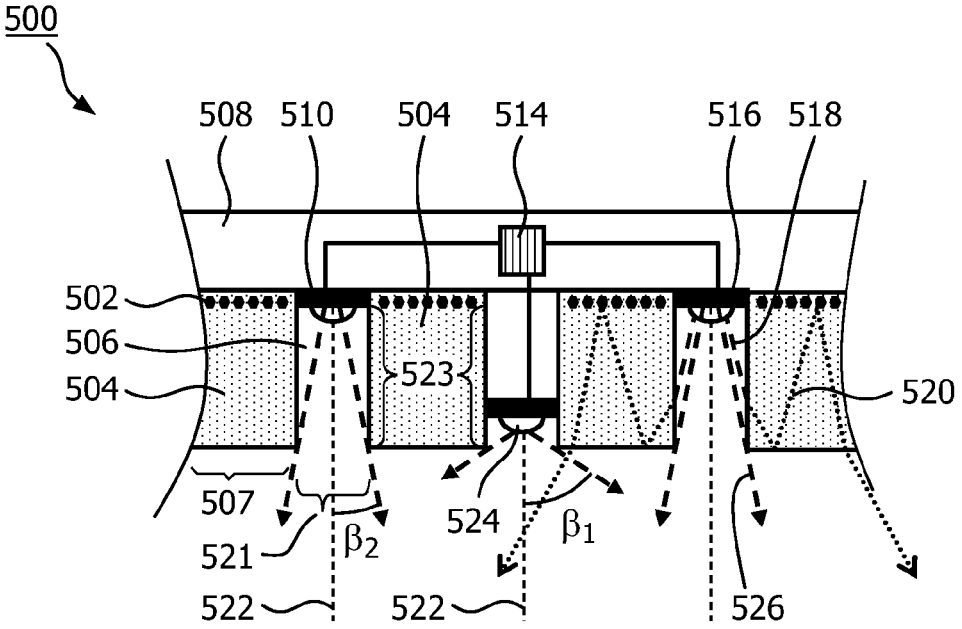

FIG. 5*a* presents another embodiment of a lighting system 500. The presented cross-section shows a lighting system 500 which comprises a housing 500 and light guide parts 504. The lighting system 500 further comprises recesses 506. Each recess 506 comprises a light exit window 521 through which white light is emitted into the ambient of the lighting system 500, and in each recess 506 a light emitter 510, 524, 516 is provided. The light guide parts 504 are made of a blue transmissive material and have (a) light input window(s) 523 which face(s) the recess 506. The light guide parts 504 further comprise light outcoupling structures 502 which are provided opposite a light exit window 507 of a light guide part.

Each light emitter 510, 516, 524 emits a light beam of white light. The light beam is relatively wide and has a relatively large maximum light emission angle $\beta_1$ with respect to a central axis of the light emission beam 522. The maximum light emission angle $\beta_1$ is, for example, larger than 60 degrees. In the presented configuration, two light emitters 510, 516 are arranged in a second relative position with respect to the light guide parts 504, and one light emitter 524 is arranged in a first relative position with respect to the light guide parts 504.

The first relative position is a position near the light exit window 521 of the recess 506. As presented in FIG. 5*a*, if the light emitter 524 is arranged in the first relative position, the emitted light beam is not blocked by any means of the lighting system 500 and the complete light beam is emitted into the ambient.

The second relative position of light sources 510, 516 is a position near the end of the recess and the end of the recess is opposite the light exit window 521 of the recess. The light beam emitted by the light sources 510, 516 is partly transmitted, without any distortion, towards the light exit window 521 of the recess and therefore a collimated light beam of white light is emitted through the light exit window 521 of the recess. This collimated light beam has a maximum light emission angle $\beta_2$ with respect to the central axis of the light beam 522, and the maximum light emission angle $\beta_2$ is at least smaller than $\beta_1$. A part of the light beams emitted by light sources 510, 516 impinge on the walls of the recess 506. The walls of the recess 506 are light input windows 523 of the light guide parts 504 and therefore this light is captured by the light guide parts 504. This is for example shown for light ray 518. The light guide parts are blue transmissive and, consequently, non-blue components of the captured light are absorbed and blue light is transmitted within the light guide part, which is for example shown for light ray 518 which becomes a blue light ray 520. When the blue light ray 520 impinges on the outcoupling structures 502, the blue light ray 520 is reflected towards the light guide light exit window 507 such that it is emitted into the ambient of the lighting system 500. As shown in FIG. 5*a*, the blue light is emitted into the ambient at light emission angles outside the collimated light beam of white light. The light outcoupling structure 502 may also be diffusely reflective, such that light which impinges thereon is scattered and, consequently, outcoupled at a plurality of light emission angles.

The lighting system 500 also comprises a controller 514 which is configured to operate the lighting system in the sunny daylight mode or in the cloudy daylight mode. The controller 514 is coupled to the light emitters 510, 524, 516 and provides a signal to the light emitters 510, 524, 516. The signal indicates whether the respective light emitters 510, 516, 524 have to operate or not. Optionally, the signal indicates at which intensity the light emitters 510, 516, 524 have to operate. If the lighting system 500 has to operate in the sunny daylight mode, only the light emitter(s) 524 arranged in the first relative position are controlled to emit light. If the lighting system 500 has to operate in the cloudy daylight mode, only the light emitter(s) 510, 516 arranged in the second relative position are controlled to emit light. For this purpose, the lighting system 500 is capable of switching between light which is comparable to the daylight of a sunny day and the daylight of a cloudy day.

The controller 514 may receive input about the relative positions of the respective light emitters 510, 516, 524. If, for example, the user may select the relative positions of the light emitters 510, 516, 524, the user may provide input to the controller 514 about the relative positions of the light emitters 510, 516, 524. In a specific embodiment, the lighting system 500 comprises position sensors for sensing actual relative positions of the light emitters 510, 516, 524. The position sensors are coupled to the controller 514 and provide information about the relative position of the light emitters 510, 516, 524 to the controller 514.

It is to be noted that the embodiment of the lighting system 500 may be combined with aspects of the lighting system 300. For example, lighting system 500 may also comprise actuators which are coupled to the light emitters 510, 516, 524, enabling the light emitters 510, 516, 524 to be moved to another relative position. The controller 514 may control the actuators in accordance with the embodiment of lighting system 300.

The idea of activating a subset of the light emitters to obtain a specific light beam and to activate another subset of the light emitters to obtain another specific light beam is well known. Published patent application WO2008/152561 discloses a luminaire which comprises light sources and optical elements. Different light sources are provided with different optical elements to obtain different light beams. Light sources with a specific optical element may be switched on to emit a specific light beam. The color emitted by the different light sources may also vary. It is to be noted that the skilled person would not consult WO2008/152561 because this patent application is not related to the field of artificial daylight light sources but to the field of lighting systems which allow the adaptation of the beam shape. Further, the disclosure of said patent application teaches the skilled person that a light source should be in the same position with respect to its optical element and that the optical elements are different, so that the beams of individual light sources obtain the required beam shape. The teaching of said patent application is different from that of the current patent application. The published patent application further teaches that different colors of light may be emitted by means of using different light sources emitting different colors, while according to the invention of the current patent application, when the light emitter is arranged in the second relative position, a part of the spectral range or a part of the emitted light is absorbed to obtain the blue light emission.

Figure 5B:
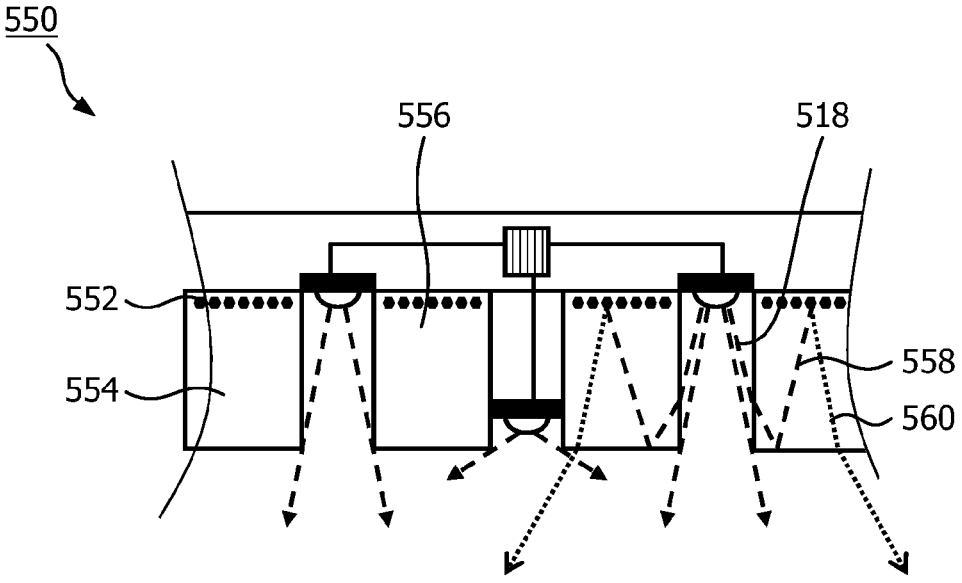

In FIG. 5*b*, an alternative lighting system 550 is presented which is similar to the lighting system 500 of FIG. 5*a*. However, the light guide parts 554 of lighting system 550 are not blue transmissive, but transmissive for white light. The light guide parts 554 comprise outcoupling structures 552 which are blue reflective, which means that they absorb non-blue components of light impinging on them and reflect the blue components only. This is presented for light ray 518 which impinges on one of the walls of the recess and is captured by the light guide part 554. Within the light guide part 554, the light ray 558 initially has the same spectral distribution as before it was captured. After impinging on the outcoupling structure 552, only the blue components of the light are reflected and a blue light ray 560 is transmitted towards the light exit window of the light guide and, consequently, blue light is emitted into the ambient of the lighting system 550.

Figure 6A:
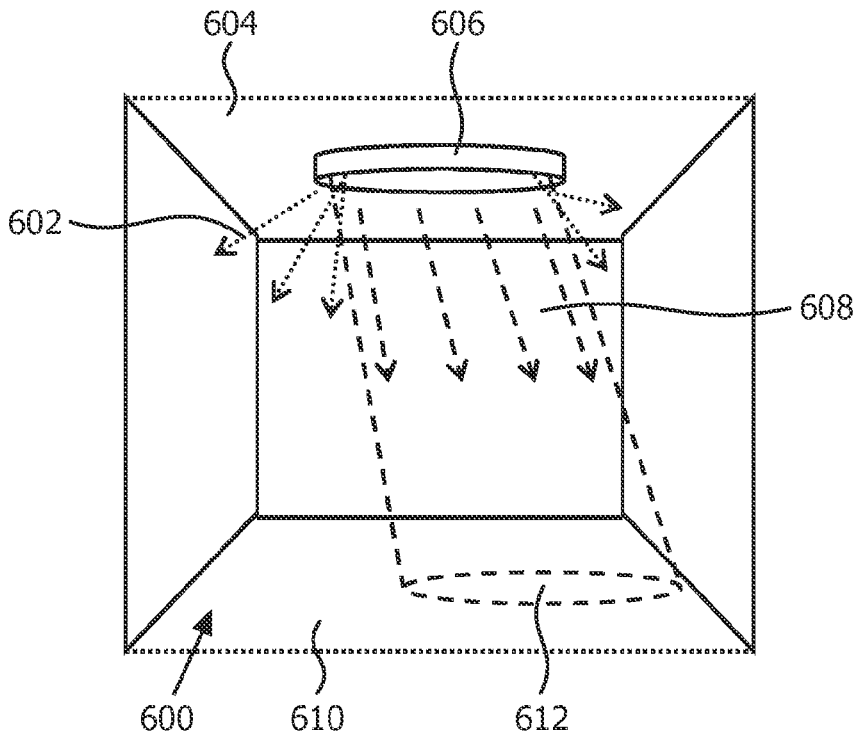

FIG. 6*a* schematically presents the interior of a room 600. A cylindrical luminaire 606 which comprises a lighting system (not shown) according to the first aspect of the invention is suspended from the ceiling 604 of the room 600.

In the situation of FIG. 6*a*, the lighting system operates in a sunny daylight operation mode. The luminaire 606 emits a collimated directed light beam 608 of white light which has a circular footprint 612 on the floor 610 of the room 600. People present in the room perceive this light emission as direct sunlight. The luminaire 606 further emits blue light 602 at least in a plurality of directions outside the collimated directed light beam 608. Thus, if a person who is not inside the collimated directed light beam 608 looks toward the luminaire 606, he perceives the luminaire 606 as a blue surface which is comparable to the blue sky on a sunny day.

Figure 6B:
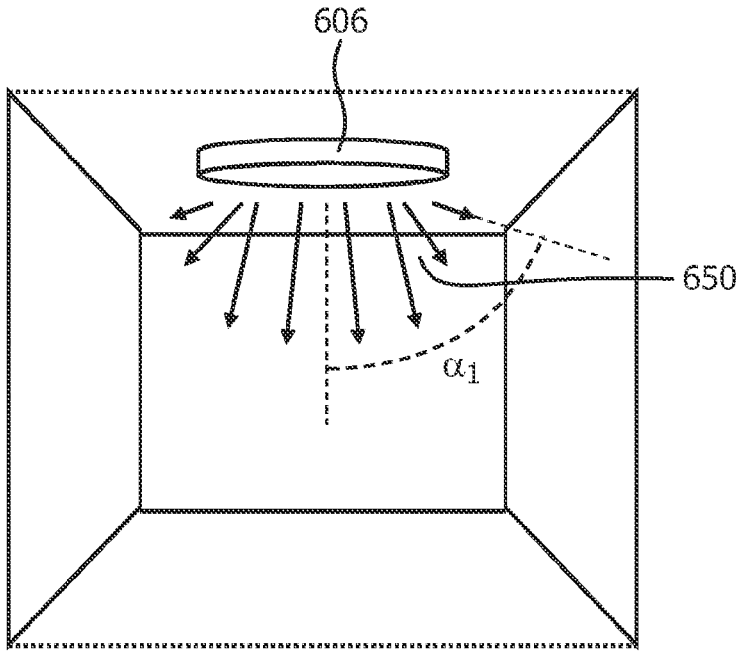

In FIG. 6*b* the lighting system of luminaire 606 operates in a cloudy daylight mode. The light emission of the luminaire comprises white light which is emitted in a relatively wide light beam. The maximum light emission angle $\alpha_1$ with respect to a central axis of the wide light beam is, for example, larger than 60 degrees. This light is perceived as light of a cloudy day by persons in the room.

It is to be noted that the shape of the presented luminaire 606 is just an example of a plurality of possible shapes. Other shapes may be selected as well, such as an (elongated) box-shaped luminaire, or a hexagonal box-shaped luminaire.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. A lighting system for providing a daylight appearance, the lighting system comprising a plurality of light emitters for emitting a wide light beam, and a plurality of optical elements, each optical element of at least a subset of the plurality of optical elements being related to a light emitter of the plurality of light emitters, thereby forming a pair, wherein, for each pair, a light emitter of a pair is configured to assume at least a first relative position with respect to the optical element of said pair, such that the light emitter and the optical element are configured to emit the wide light beam, and a second relative position with respect to the optical element of said pair, such that the optical element is configured to collimate a portion of light of the wide light beam to obtain a collimated light beam, and to absorb another portion of light of the wide light beam in a predefined spectral range to obtain a blue light emission at light emission angles at least outside the collimated light beam.

2. A lighting system according to claim 1, further comprising a controller for controlling the lighting system to operate in a sunny daylight mode or a cloudy daylight mode, wherein the lighting system is configured to activate light emitters which are arranged in the second relative position in the sunny daylight mode, and the lighting system is configured to activate light emitters which are arranged in the first relative position in the cloudy daylight mode.

3. A lighting system according to claim 2, wherein the light emitters are movable between the first relative position and the second relative position, and vice versa, in response to receiving a control signal, and the controller being configured to generate the control signal.

4. A lighting system according to claim 2, wherein a first subset of the light emitters is arranged in the first relative position with respect to its related optical element, and a second subset of the light emitters is arranged in the second relative position with respect to its related optical element, the controller being configured to control the light emitters of the first subset to emit light when the lighting system has to operate in a cloudy daylight mode and to control the light emitters of the second subset to emit light when the lighting system has to operate in a sunny daylight mode.

5. A lighting system according to claim 1, wherein the light emitters are movable between the first relative position and the second relative position and the lighting system is arranged to enable a user of the lighting system to move at least a subset of the light emitters from the first relative position to the second relative position and vice versa, or to move at least a subset of the optical elements to arrange the subset of light emitters in the first relative position or in the second relative position.

6. A lighting system according to claim 1, wherein the optical elements comprise a light transmitting cavity, and each light transmitting cavity comprises a light exit window and walls facing the light transmitting cavity, the walls being light reflective in a blue spectral range, the light emitters are arranged within the light transmitting cavities of their related optical elements, the first relative position of a specific light emitter is a position of the specific light emitter near the light exit window of the light transmitting cavity, the second relative position of a specific light emitter is a different position inside the light transmitting cavity, said different position being at a distance from the light exit window, and in said different position the specific light emitter is arranged to partially emit light towards the walls.

7. A lighting system according to claim 6, wherein the light transmitting cavity is a cylindrical light transmitting channel, a conically shaped cavity tapering out towards the light exit window, or a cavity having a curved profile.

8. Alighting system according to claim 1, wherein each optical element comprises a light guide part and a recess, each light guide part having a light input window facing the recess, and comprises a light exit window of the light guide arranged on a first side of the light guide part, and light outcoupling structures arranged on a second side of the light guide part opposite the first side, and each recess comprising a light output window on the first side of the light guide part and extending in a direction from the second side to the first side of the light guide part, the light emitters are arranged within the recess of the light guide part of its related optical element, the first relative position of a specific light emitter is a position near the light exit window of the recess, the second relative position of a specific light emitter is a different position inside the recess, said different position is at a distance from the recess light output window, and the light guide part is arranged to capture via the light input window a part of the light emitted by the specific emitter, wherein the light outcoupling structures are light reflective in a specific spectral range to obtain a blue light emission through the light exit windows of the light guide parts and/or at least a part of the light guide parts are light transmissive in the specific spectral range to obtain a blue light emission through the light exit windows of the light guide parts.

9. A luminaire comprising the lighting system according to claim 1.

* * * * *